US005226241A

United States Patent [19]

Goodwin

[11] Patent Number: 5,226,241

[45] Date of Patent: Jul. 13, 1993

[54] WEIGHT DRIVEN KILN CONTROL

[75] Inventor: Thomas E. Goodwin, Orange Park, Fla.

[73] Assignee: U.S. Natural Resources, Inc., Vancouver, Wash.

[21] Appl. No.: 884,126

[22] Filed: May 18, 1992

[51] Int. Cl.[5] ..... F26B 3/02

[52] U.S. Cl. ..... 34/30; 34/46

[58] Field of Search ..... 34/12, 16.5, 54, 56, 34/53, 48, 13.8, 25, 30, 45, 44, 46; 364/477, 150, 499, 496

[56] References Cited

U.S. PATENT DOCUMENTS 4,176,464 12/1979 Randolph ..... 34/13.8

*Primary Examiner*—Henry A. Bennett

*Attorney, Agent, or Firm*—Robert L. Harrington

[57] ABSTRACT

A weight driven kiln control system is shown and described wherein a digital scale provides sample board weight values to a kiln control system in association with sample board identification values whereby the control system may drive a load through a given drying schedule by inferring the moisture content of the load based on received weight values for a set of sample boards. The control system requires less operator expertise in manipulating the progress of the kiln through the drying schedule, and allows the kiln control system to make certain judgements about the rate of drying within the kiln and independent adjustments, if so authorized, in the drying schedule based on a calculated drying rate.

18 Claims, 4 Drawing Sheets

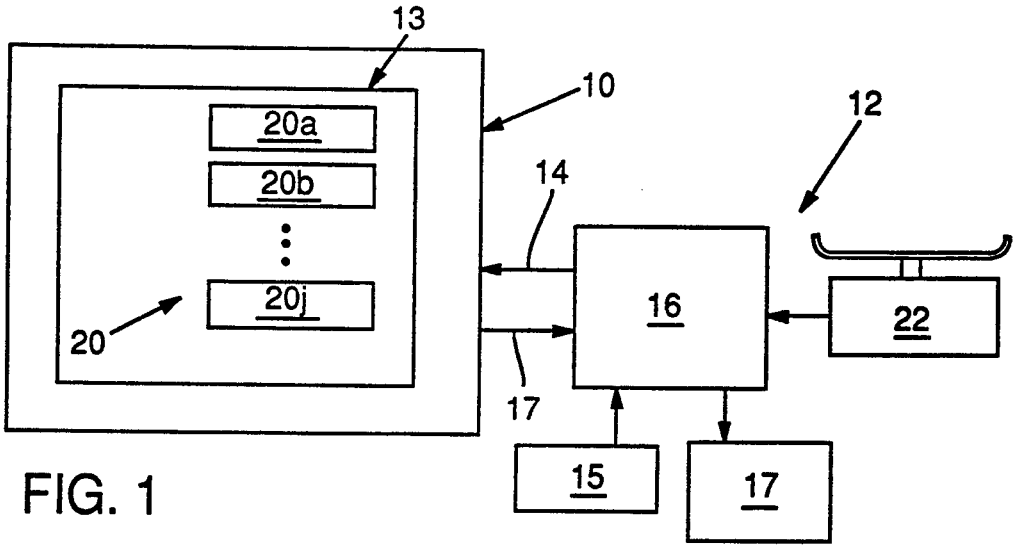
FIG. 1
FIG. 2
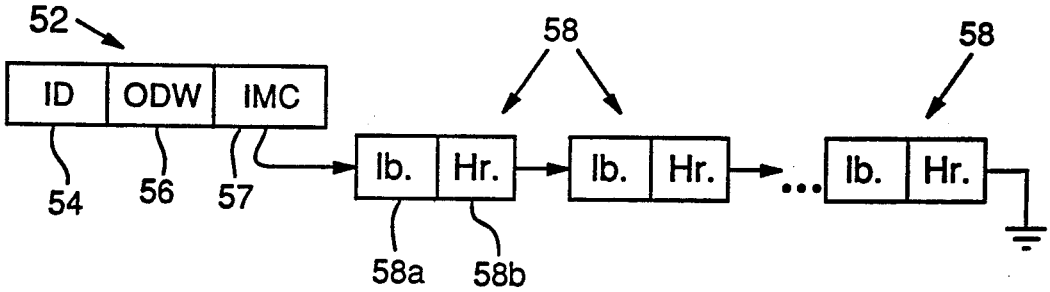
FIG. 3
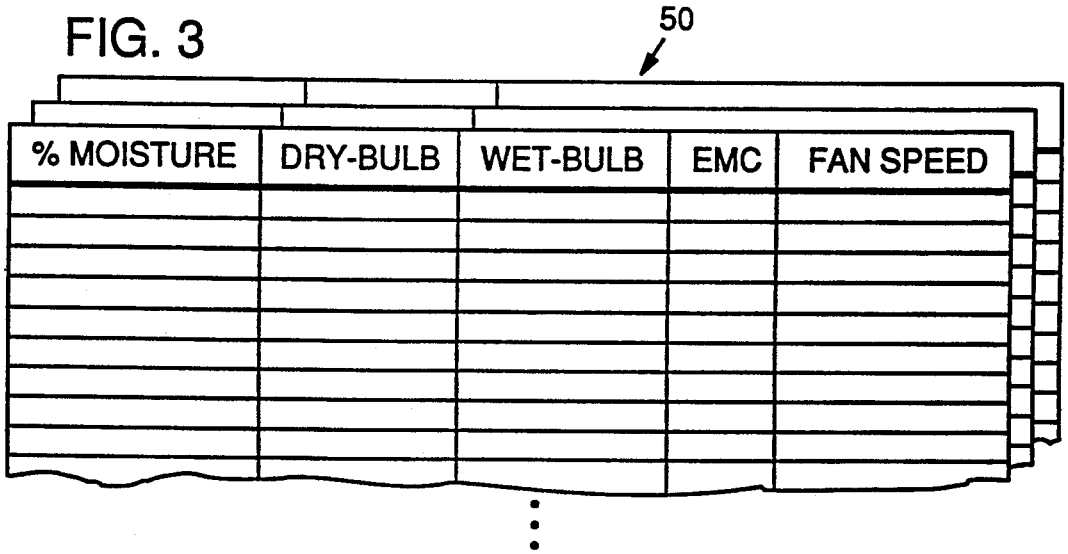

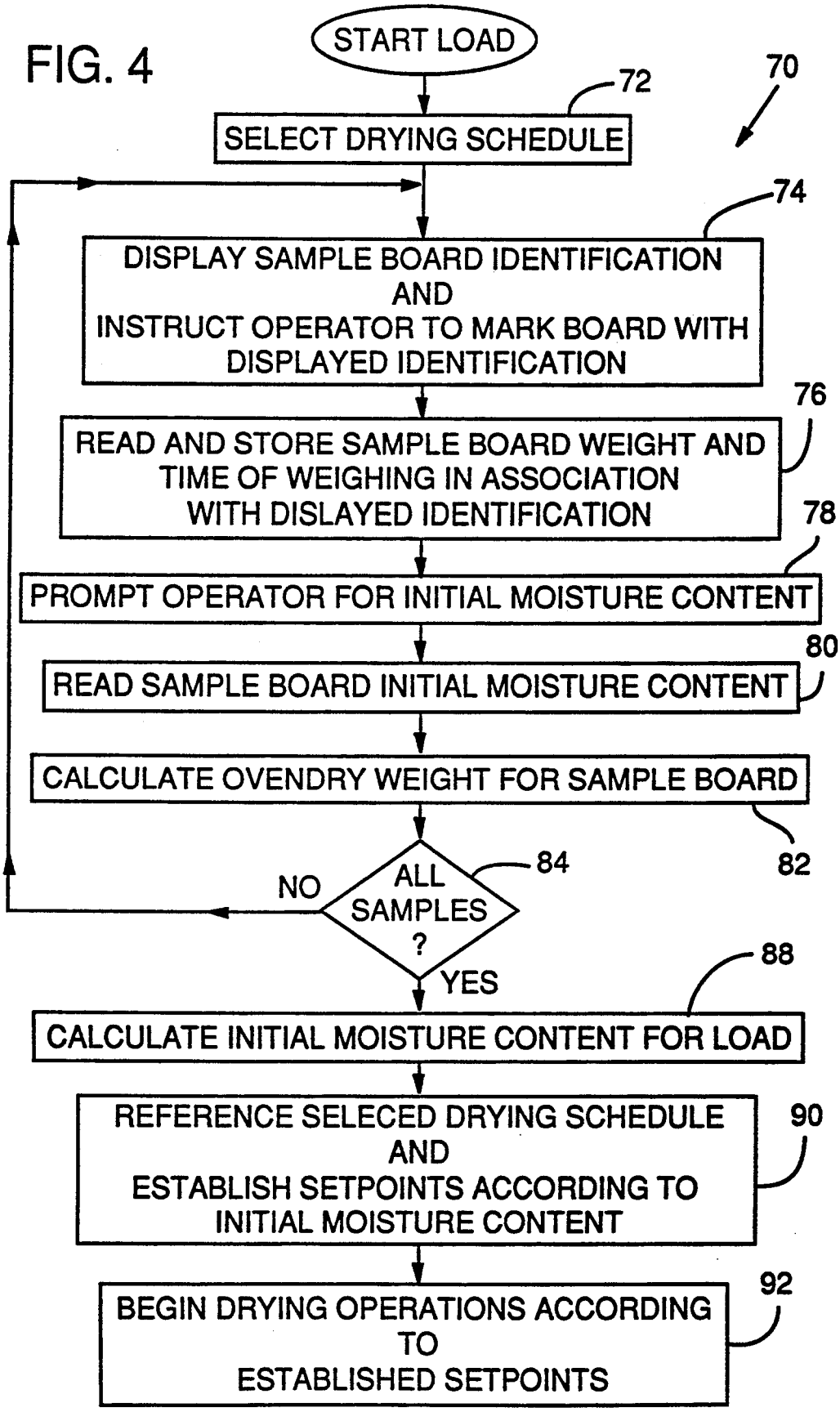
FIG. 4
START LOAD
70
72
SELECT DRYING SCHEDULE
74
DISPLAY SAMPLE BOARD IDENTIFICATION AND INSTRUCT OPERATOR TO MARK BOARD WITH DISPLAYED IDENTIFICATION
76
READ AND STORE SAMPLE BOARD WEIGHT AND TIME OF WEIGHING IN ASSOCIATION WITH DISLAYED IDENTIFICATION
78
PROMPT OPERATOR FOR INITIAL MOISTURE CONTENT
80
READ SAMPLE BOARD INITIAL MOISTURE CONTENT
CALCULATE OVENDRY WEIGHT FOR SAMPLE BOARD
82
84
ALL SAMPLES ?
NO
YES
88
CALCULATE INITIAL MOISTURE CONTENT FOR LOAD
REFERENCE SELECED DRYING SCHEDULE AND ESTABLISH SETPOINTS ACCORDING TO INITIAL MOISTURE CONTENT
90
BEGIN DRYING OPERATIONS ACCORDING TO ESTABLISHED SETPOINTS
92

WEIGHT DRIVEN KILN CONTROL

BACKGROUND OF THE INVENTION

The present invention relates generally to control apparatus, and particularly to control apparatus for a drying kiln.

Large enclosures are used as kilns for removing moisture from lumber products by circulation of heated air within the kiln. For example, green lumber is stacked for drying by placing stickers between each layer of lumber to permit airflow therethrough and the stacks are placed in a heated building structure, i.e., kiln, with controlled ventilation and circulation to pass sufficient air through the stacks and carry away the moisture of the lumber. In such control systems the kiln may include various sensors for detecting kiln conditions such as dry-bulb and wet-bulb sensors and mechanisms for introduction of new air, expulsion of moisture laden air, circulation of air and operation of a heating system for maintaining given conditions, e.g., dry-bulb and wet-bulb setpoints, within the kiln.

The process of drying lumber within a kiln is driven primarily by the current moisture content of the lumber within the kiln. A drying schedule determines the specific control steps taken, typically variation in kiln conditions such as a schedule of dry-bulb and wet-bulb setpoints as a function of current moisture content. The schedule advances generally as a function of the amount of moisture in the lumber, and not consistently as a function of time. The load moisture content of each load can be different and kiln external conditions, which affect drying time, vary as well. As the lumber becomes drier, the control process is modified according to a selected drying schedule in order to dry the wood in an energy efficient and timely manner.

Under current practice, an operator cuts sample boards and makes drying pockets in the packs or loads of lumber to be placed into the kiln for drying. This step is done while stacking the lumber, or just before the kiln is loaded. Normally there are six to eight sample boards per kiln charge. If the lumber is green and not air dried, the operator will start-up the kiln on the first step of a given drying schedule specifying, for example, particular dry-bulb and wet-bulb setpoints. While the kiln is running the operator will take each sample board and cut a wafer section from each end of each board. The operator will then weigh each wafer and write its weight on the wafer, and will weigh each sample board and write its weight on the sample board. After numbering for identification each wafer and each sample board, the operator will end-coat the sample boards and place the boards back into the pocket of the load in the dry kiln to continue drying of sample boards with the rest of the lumber in the kiln. The operator then places the wafers in the oven and dries them completely. This normally takes from 20 to 24 hours. Then, using a formula for figuring moisture content, the original moisture content of each wafer is calculated. Adding two moisture content values for each wafer and dividing by two the operator can calculate the moisture content for the sample board before it was placed into the kiln. Using the average moisture content of the wafers, the original weight of the sample boards, and the formula for ovendry weight, the ovendry weight for each sample board can be calculated. The operator then pulls the sample boards out of the kiln and writes the ovendry weight for each sample board on it for future reference, and then puts it back into the pocket in the kiln. The operator then knows the moisture content of each sample board and by taking the moisture content for the three wettest boards and averaging these moisture content values the moisture content for the load is obtained and suitable setpoints are derived as a function of that load moisture content from the selected drying schedule. More particularly, the kiln may be started at step 1 in the drying schedule, but with the ,current moisture, content it is possible to skip subsequent steps in the drying schedule, e.g., go directly from step 1 to step 3, based on the current moisture content of the load. For example, on green oak and the more difficult to dry hardwoods, the operator will probably pull the sample boards each day to check them for moisture content and in response to the calculated moisture content adjust the drying schedule appropriately.

As may be appreciated from the above description of conventional kiln operation, many mistakes can be made as many calculations are performed by the operator and many transfers of hand-written information are performed. Accordingly, with such complex operator interaction and required steps there is a corresponding greater opportunity for math errors and errors in transcribing data by hand. As a result, the conventional practice of kiln operation can offer opportunity for inappropriate drying of lumber, and for excess waste of energy resources in connection with the kiln operation.

Accordingly, it is desirable that kiln operation be made more automatic and more fully support the operator in avoiding such opportunities for error. Furthermore, it is desirable that the kiln operator be provided with greater information regarding anticipated timing for advancing the drying process to the next step in the drying schedule. Under conventional practice, the operator must check the sample boards as a routine procedure and may check those sample boards several times before the calculated load moisture content indicates a required change in the drying schedule, i.e., a change in established setpoints for the kiln. Also, under present practice the operator may miss a required change in the drying schedule and the kiln will for a time inappropriately operate, i.e., be energy inefficient, with respect to the actual moisture content of the load.

Under more automated conventional practice, some kiln control systems offer a computer system with a selection of drying schedules obtained by menu driven operation of the computer. The computer can automatically advance to a subsequent step in such drying schedules, but only in response to manual input of moisture content data, i.e., as derived by the operator according to the method described above and manually input into the computer as moisture content values. It would be desirable, therefore, that the operator not perform all the steps and procedures associated with obtaining such moisture content values, rather that the operator need only perform a minimally complex procedure for checking the current condition of a load within a kiln. Under conventional practice, in order to perform this step the operator must intermittently derive moisture content values for the sample boards. As described above, this procedure requires many steps and specific calculations to be performed by the operator.

It is desirable, therefore, that a kiln control scheme allow less sophistication or less expertise on the part of the operator and allow the overall process to be more efficiently implemented with less human interaction with respect to calculations and manipulation of sample boards.

SUMMARY OF THE INVENTION

The subject matter of the present invention provides a mechanism for better advancing a selected drying schedule in response to the current moisture content of the lumber being dried. In accordance with a preferred embodiment of the present invention a computerized kiln control is used in conjunction with an electronic digital scale. The digital scale provides at intermittent times during the drying process the weights of a set of sample boards. The weight of each sample board can be taken as a representation of the moisture content of that board. Furthermore, a rate of weight change of a given sample board is representative of a rate of drying for that board. The computer of the kiln controller receives and tracks the weights for each of the sample boards, and monitors the overall drying process by inferring the moisture content of the kiln load as a whole. The controller may also infer the current drying rate for the load as a whole based on a collection of weight samples taken over time. The current drying rate provides a basis for predicting the time for the next required advance in the drying schedule. As a result, the overall drying process is made more automatic, more efficient, and more easily executed.

The subject matter of the present invention is particularly pointed out and distinctly claimed in the concluding portion of this specification. However, both the organization and method of the operation of the invention, together with further advantages and objects thereof, may best be understood by reference to the following description of a particular embodiment of the invention taken with the accompanying drawings wherein like reference characters refer to like elements.

BRIEF DESCRIPTION OF THE DRAWINGS

For a better understanding of the invention, and to show how the same may be carried into effect, reference will now be made in illustration of a particular embodiment of the invention to the accompanying drawings in which:

FIG. 1 is a block-level schematic illustration of a kiln for drying hardwood lumber including a control system according to the present invention.

FIG. 2 is a data structure used in conjunction with the control system of FIG. 1 for maintaining information corresponding to selected sample boards representing the condition of a load within the kiln of FIG. 1.

FIG. 3 illustrates drying schedules used by the control system of FIG. 1, of which one such drying schedule is selected for a given load to be dried in the kiln of FIG. 1.

FIG. 4 is a flow chart illustrating a procedure executed in cooperation with operator interaction for initiating a drying cycle using the kiln and control system of FIG. 1.

DETAILED DESCRIPTION OF A PREFERRED EMBODIMENT

Figure 5:
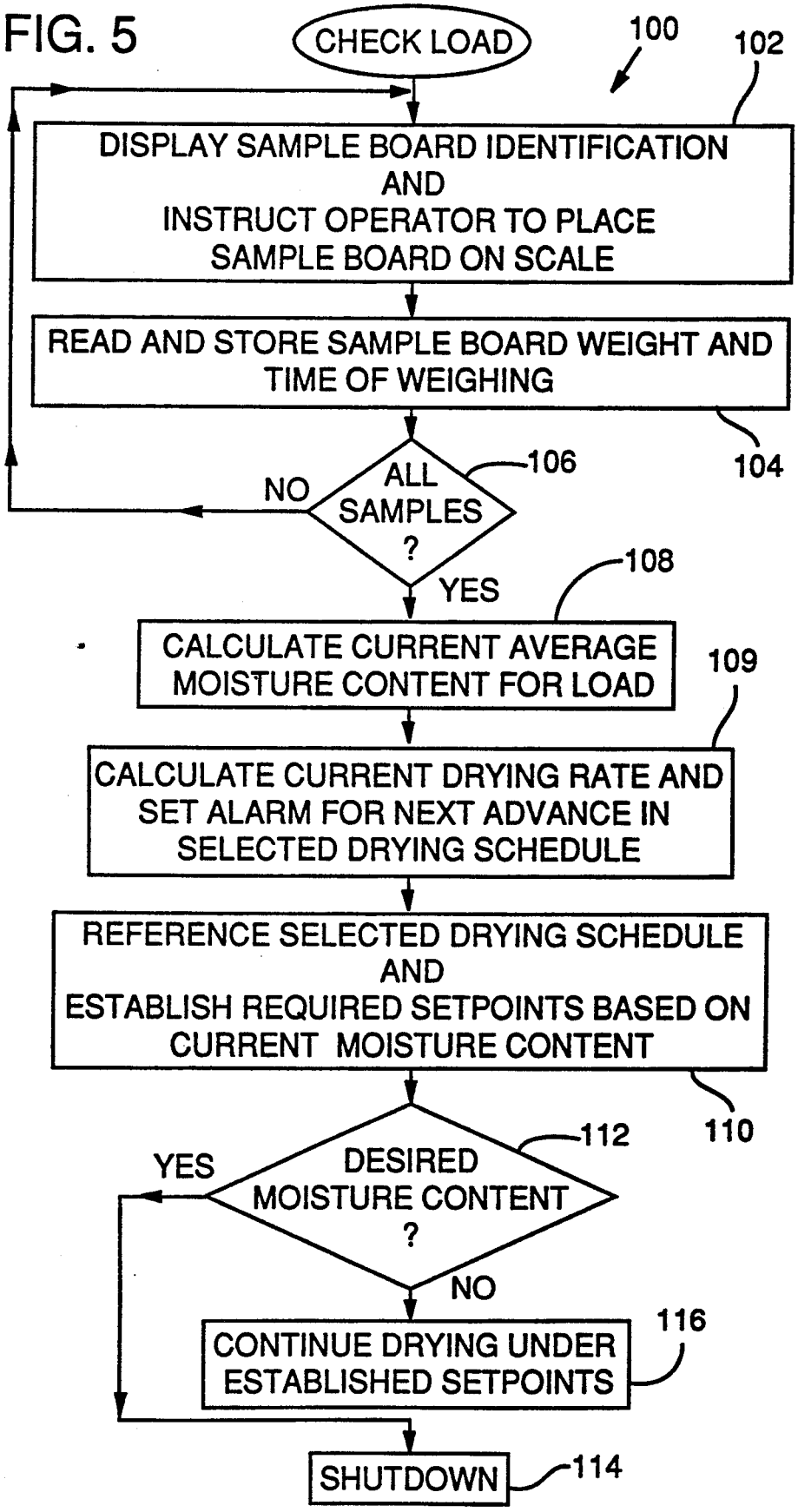
FIG. 5 is a flow chart illustrating a load checking procedure executed periodically in cooperation with an operator of the kiln.

FIG. 1 illustrates schematically a kiln 10 and a control system 12 for controlling conditions in the kiln 10 in such manner to implement a drying schedule for a given load 13 of hardwood lumber within the kiln. As may be appreciated, a great variety of control mechanisms exist for aiding implementation of drying schedules in a kiln. As for the present invention, it will be understood that the basic form of control system 12 may be of a variety of forms according to such known practice to implement drying schedules according to some selected criteria. Accordingly, system 12 issues control output signal 14 to kiln 10 for invoking operations within kiln 10 such as circulation of air, heating of air, and venting of air into and out of kiln 10. System 12 monitors kiln 10 internal conditions such as dry-bulb and wet-bulb values from sensors input signal 17.

Before the drying process begins, the appropriate drying schedule for the load 13 is selected and identified by an operator at keyboard 15 of computer 16. Drying schedules consist of a variable number of steps, each with, for example, dry-bulb and wet-bulb setpoints in association with given moisture content values. Thus, once a drying schedule is selected and a current moisture content for load 13 provided, the control system 12 monitors input signal 17 and delivers the appropriate control output signal 14 for establishing and maintaining such setpoints in response to the current moisture content of the load 13.

Sample boards 20 of load 13 are identified and normally kept within the kiln. In the illustrated embodiment ten such sample boards 20, individually 20*a*–20*j*, are used. To obtain data regarding the general condition of the load 13 during drying in kiln 10, the sample boards 20 are periodically removed from the kiln 10 and placed on a digital scale 22 which provides its output, i.e., the weight of the sample board 20 currently placed thereon, to a computer 16 of the kiln control system 12. The scale 22 transmits the weight of the sample board 20 directly to the computer 16 via, for example, an RS-232 communication port using standard ASCII format. In conjunction with the weighing of a sample board 20, the operator provides directly to the kiln controller by way of keyboard 15 the sample board identification, in the present illustration a single letter in the range a–j.

At the beginning of a drying cycle, the operator inputs directly to the computer 16 the initial moisture content of the sample. With these two pieces of information, i.e., the initial moisture content and initial weight of the sample boards 20, the computer 16 can calculate an ovendry weight for each sample board 20. Having the ovendry weight, the system 12 can at any point calculate the current moisture content based on a current weight input for a particular sample board 20.

After all the sample boards have been initially processed, the computer 16 calculates an average moisture content of the load 13 based on the wettest of the sample boards.

Given the current moisture content of load 13, computer 16 establishes dry-bulb and wet-bulb setpoints from the appropriate point in the selected drying schedule. As the load 13 continues to dry, sample boards 20 are periodically removed from the kiln by an operator and sequentially weighed on scale 22 and identified to the computer 16 by way of keyboard 15. For each such process of removing a sample board 20 and placing it on the scale 22, the system 12 determines the current moisture content of the sample board 20 by inference based on the current weight, the initial weight, and the ovendry weight. Once the computer 16 receives a complete set of weight values for sample boards 20, computer 16 once again calculates an average moisture content based on the wettest of sample boards 20. Given a new current average moisture content, the system 12 then has sufficient information to identify suitable dry-bulb and wet-bulb setpoints from the selected drying schedule and continue drying the load 13 under the appropriate setpoints.

When the average moisture content is equal to or less than the desired moisture content according to the selected drying schedule, the computer 16 will shutdown kiln 10 by way of control signal 14. During the drying process, the computer 16 otherwise monitors input signal 17 and maintains the setpoint values by suitable presentation of output signal 14 until receiving a new set of sample weights which indicate sufficient change in moisture content to move to a subsequent step in the drying schedule.

System 12 may be modified, however, to predict a drying rate for the load 13. The controller tracks a series of calculated average moisture content values and establishes a drying rate based on the progression of the current moisture content values toward the desired moisture content. By thereby calculating the average moisture content lost over time, the controller may be programmed to independently advance to a next stage in the drying schedule without operator intervention, i.e., as a function of calculated drying rate.

The average loss per time in the illustrated embodiment is based on the average moisture content lost during the previous four sample collections. If less than four but at least two samples have been recorded, system 12 calculates average moisture content with a minimum of two samples. As use herein, the average moisture content lost is expressed as an average percentage loss per day. For example, consider the moisture content entry at a given location in the drying schedule as 25%, the current average moisture content as 29%, and the average loss per day as 2%. After one day of drying the average moisture content is found to be 27%, but does not require any advance in the drying schedule because the next step begins at 25% moisture content. Thus, after two days, and with no further input from or action by the operator as to the current moisture content, the computer 16 can independently calculate the average moisture content as being 25% based on the calculated 2% moisture content loss per day. Beyond this point, however, the computer 16 of the illustrated embodiment does not advance the drying schedule until the operator provides new data as to the actual weight of the sample boards 20, and the moisture content loss per time is accurately recalculated.

The ability of the present invention to project moisture content values based on previous loss rates allows system 12 to advance to subsequent drying schedule steps more quickly and, therefore, more efficiently. The computer 16 is not, however, given complete control of the drying process and cannot independently advance the schedule without limitation. Risk of lumber damage due to inappropriate drying conditions or excess energy loss is thereby minimized.

As may be appreciated by those skilled in the art, the present invention provides a simplified control arrangement not requiring any particular expertise or time consuming tasks on the part of the operator. Under the present invention, the operator needs little expertise other than that required to pull sample boards 20 from the kiln 10, place each sample board on the scale 22, and identify by a single keystroke at keyboard 15 each sample board 20 as placed on the scale 22. The computer 16 then has sufficient information to infer the current moisture content of the load 13 and, if necessary, advance the load 13 through the next drying schedule stage.

The computer 16 of the control system 12 for kiln 10 may be provided by a conventional programmable microcomputer product. Given such a programmable computing resource, it may be appreciated that computer 16 would have a clock device for associating a time of day value with data collection, i.e., time stamping weight values for the sample boards 20. Also, computer 16 can drive a display screen 17 for interacting with the operator. The computer 16, according to general programming techniques, contains data structures for tracking the sample boards 20 and maintaining associated information such as an ovendry weight and successive weight measurements in association with a time of taking such weight measurements. Also, computer 16 holds a variety of drying schedules and allows operator selection among such drying schedules for determining operation of system 12.

FIG. 3 illustrates a collection of drying schedules 50 stored within computer 16. In the illustrated embodiment, drying is accomplished by maintaining certain dry-bulb and wet-bulb setpoints for the kiln 10 as well as other associated control information such as equilibrium moisture content (EMC) values and fan speed values. The selection among such dry-bulb and wet-bulb setpoints and associated control information is a function of the current moisture content of load 13. Each drying schedule 50 is a table of numeric values with each row corresponding to one step in the drying schedule. The first column of each drying schedule 50 holds a moisture content value expressed as a percentage. The remaining columns in each row are setpoints and associated control information determining operation of the kiln 12 at the associated current moisture content level. Thus, given the current moisture content of load 13, computer 16 references a selected drying schedule 50, identifies the row associated with the current moisture content, and identifies the required operational setpoints as a function of the current moisture content. In this manner, a drying schedule 50 determines the operation of the kiln 10 as a function of the current load 13 moisture content.

FIG. 2 illustrates a data structure 52 associated with each of the sample boards 20 in execution of the method of control under the present invention. In FIG. 2, the sample board 20 data structure 52 includes an identification field 54 as a key or index to a set of such data structures 52. The field 54, in the illustrated embodiment, holds a single character value in the range a–j identifying one of sample boards **20*a*–20*j*, respectively. The ovendry weight field 56 is completed by the operator and represents the desired ovendry weight of the sample. Field 56 is referenced for purposes of calculating a current moisture content for any given sample board 20 based on a current weight value. The initial moisture content field 57 holds an operator supplied value representing the moisture content of the associated sample board 20 at the beginning of a drying cycle. The remainder of data structure 52** comprises linked list of samples 58. Each sample 58 includes a weight value 58*a* and a time of sample value 58*b*. Thus, it may be appreciated how the computer 16 may receive a weight value 58*a* from scale 22, associate the weight value 58*a* with a sample board 20, reference its system clock to obtain a time of sample value 58*b*, and associate the weight value 58*a* and the time of sample value 58*b* with a sample board 20 to complete and store each sample 58. The initial weights and time of initial sample for each of the sample boards 20 can be stored as the first sample 58, i.e., the time of sample value 58*b* corresponding to the beginning of the drying cycle.

FIG. 4 illustrates a procedure associated with initially beginning a drying cycle using kiln 10 and control system 12. In FIG. 4, the operator invokes start load procedure 70 when a new load 13 has been placed in kiln 10. Processing begins at block 72 where computer 16 prompts the operator, i.e, by way of display 17, to select a drying schedule 50. Once this drying schedule 50 is selected, the numeric values held in the selected drying schedule 50 determine operation of system 12 until a desired moisture content is achieved. Processing continues to block 74 where computer 16 displays the first sample board 20*a* identification value "a", instructs the operator to mark a first sample board 20 with the identification value "a", and instructs the operator to place the sample board 20*a* on the scale 22. In block 76, computer 16 reads a weight value 58*a* for the sample board 20*a* and appropriately stores that value 58*a* along with the time of sample value 58*b* in the first sample 58 for the structure 52 corresponding to the first sample board 20*a*.

In block 78, computer 16 prompts the operator for an initial moisture content for the sample board 20*a*. To calculate the initial moisture content for a sample board the operator obtains a wafer section of the sample board and dries this wafer in a separate oven to remove all moisture from the wafer. The initial moisture content for the corresponding sample board is then calculated as the original wafer weight minus the ovendry weight, then divided by the ovendry weight, and then multiplied by a factor of 100 to obtain a percentage value. Computer 16 then reads this initial moisture content value from keyboard 15 in block 80 and stores this value in field 57 of the data structure 52 for sample board 20*a*.

In block 82, computer 16 calculates and stores an ovendry weight 56 for sample board 20*a* using the initial moisture content for sample board 20*a* and the initial weight for sample board 20*a*. More particularly, to obtain the ovendry weight of a sample board 20, the original weight is divided by the sum of 100 and the initial moisture content of the board, the result is then multiplied by a factor 100 to obtain a percentage value.

Continuing to decision block 84, computer 16 determines whether all sample boards 20 have been initially entered and recorded in the system 12. Processing then branches back to block 74 where the next sample board 20*b* identification value, i.e., the letter "b", is displayed and the operator is instructed to mark the next sample board 20*b* with that identification and place it on the scale 22. Processing repeats through the blocks 74, 76, 78, 80, 82 and 84 until all sample boards 20 have been initially entered into the system including a desired ovendry weight 56, initial moisture content value 57, an initial weight value 58*a*, and time of weighing value 58*b* for each sample board 20.

After all the sample boards 20 have been initially entered into system 12, computer 16, in block 88, calculates the average moisture content for the load 13 based on the wettest of sample boards 20. Given the average moisture content for the load 13, computer 16 references in block 90 the currently selected schedule 50 to obtain and establish the required operational setpoints for the current moisture content of the load 13. Processing then advances to block 92 where computer 16 invokes the necessary control signal 14 to implement the established operational setpoints. Drying of the load 13 then progresses according to conventional practice whereby system 12 maintains the established operational setpoints for the kiln 10.

FIG. 5 illustrates a check load procedure 100 periodically executed by the operator of system 12 in order to collect a set of samples 58, i.e., one for each of sample boards 20. In FIG. 5, the check load procedure 100 begins in block 102 where computer 16 displays the first sample board identification, i.e., the letter "a", and instructs the operator to place sample board 20*a* on the scale 22. Then in block 104, computer 16 reads a weight value 58*a* and a time of sample value 58*b* and stores this information as a sample 58 associated with the structure 52 for the sample board 20*a*. In decision block 106 computer 16 determines whether or not all sample boards 20 have been weighed. If all the sample boards 20 have not yet been weighed, computer 16 then returns to blocks 102 and 104 to sequentially prompt the operator for each of the remaining sample boards 20*b*–20*j* and reads the associated weight values 58*a* and time of sample values 58*b* for each remaining sample board 20*b*–20*j* and adds a sample value 58 to each remaining sample board 20*b*–20*j* data structure 52.

Once all the sample boards 20 have been weighed, processing branches from decision block 106 to block 108 where computer 16 calculates an average moisture content for load 13 based on the wettest of sample boards 20 as indicated in the most recent collection samples 58. More particularly, the current moisture content for a given sample board 20 is calculated as the current weight for the sample board 20 minus the ovendry weight for that sample board 20 as held in the associated data structure 52, and then divided by the ovendry weight for that board, the result is then multiplied by a factor of 100 to obtain a percentage expression. As discussed more fully below, in block 109 computer 16 calculates a current drying rate for the load 13. This drying rate is used to set an interrupt for an alarm procedure indicating a most likely time for the next advance in the selected drying schedule 50. Continuing to block 110, computer 16 uses the calculated current average moisture content for the load 13 to determine whether or not the drying schedule is to be advanced. Thus, computer 16 uses the calculated average moisture content to identify the appropriate dry-bulb and wet-bulb setpoints and other operational setpoints and establishes these setpoints for the next phase of drying. In decision block 112, computer 16 determines whether or not the current moisture content of the load has reached a desired moisture content. If the desired moisture content according to the selected schedule 50 has been achieved, computer 16 branches from decision block 112 to block 114 where kiln 12 is shutdown. If, however, in decision block 112 computer 16 determines that the load 13 has not yet achieved its desired moisture content, processing continues to block 116 where the kiln continues drying operations under the currently established operational setpoints.

As the process of drying continues, the operator will intermittently execute the check load procedure 100. Over time the computer 16 then has available a collection of board weights and associated times of weighing which may be used to calculate in block 109 a drying rate for the load 13. When sufficient number of samples 58 have been collected to provide a basis for calculating a drying rate for load 13, computer 16 will calculate a drying rate for load 13 and store this value for future reference. Computer 16 can thereby anticipate an appropriate or most likely time for next advancing the drying process to the next stage in the selected drying schedule 50. Using this drying rate, in block 109, the computer 16 can set an alarm or display a time and date which will inform the operator of the likelihood of a need to advance to the next stage in the drying schedule, i.e., a need to execute the check load procedure 100 of FIG. 5. Thus, computer 16 can at the time of calculating the drying rate for load 13 indicate on display 17 a predicted time at which the moisture content of the load 13 will reach the next stage in the drying schedule 50. With this information, the operator can then return to the kiln and interact with the computer 16 to provide a next set of weight values for the sample boards 20 by executing check load procedure 100. The operator thereby has the important advantage of knowing approximately when the next data collection should be conducted. Overall efficiency of the kiln 10 is thereby improved.

Figure 6:
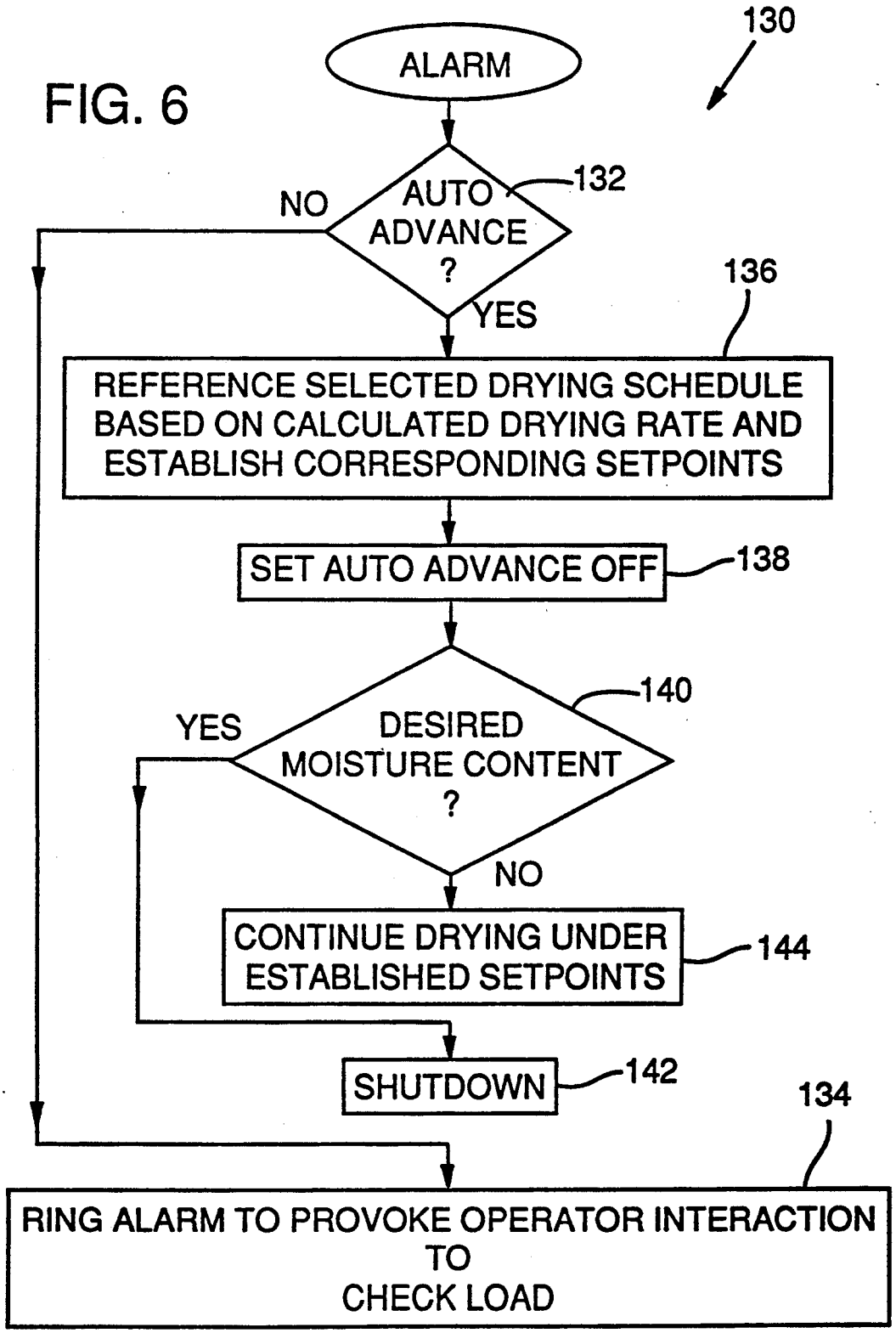
FIG. 6 is an alarm procedure including an automatic advance feature of the present invention for execution by the control system of FIG. 1.

FIG. 6 illustrates an alarm procedure 130 which may be automatically executed by computer 16, e.g., by timer interrupt, based on a calculated drying rate for the load 13. In FIG. 6, the alarm procedure 130 begins in decision block 132 where computer 16 determines whether or not an automatic advance feature is enabled. If the automatic advance feature is not enabled, processing branches to block 134 where computer 16 will ring an alarm and thereby inform the operator of a need to execute the check load procedure 100 (FIG. 5) and then terminate. If, however, decision block 132 determines that the automatic advance feature is enabled, processing branches at block 132 to block 136 where computer 16 will infer, based on a calculated drying rate, the current moisture content of the load 13 with this inferred moisture content, new setpoints are established according to the selected drying schedule 50.

Continuing to block 138, computer 16 then deactivates the automatic advance features as a safety precaution against allowing the computer 16 to indefinitely continue its control over the drying schedule. As may be appreciated by those skilled in the art, the automatic advance feature could implement more complete control over the drying schedule, but in the illustrated embodiment has limited authority to advance the drying schedule one step. In the illustrated embodiment, this limited authority is represented by allowing the computer 16 to advance the drying schedule one time based on a calculated drying rate. It will be understood, however, that the scope of the invention is not limited to a single automatic advance of the drying schedule under the control of computer 16.

Continuing to decision block 140, computer 16 then determines whether, based on the calculated drying rate, the load 13 has achieved its desired moisture content. If the load 13 has achieved its desired moisture content, then processing branches to block 142 where computer 16 shuts down kiln 10. If the drying process is not yet complete, however, processing branches from block 140 to block 144 where computer 16 operates kiln 10 under the then established dry-bulb and wet-bulb setpoints.

Thus, an improved kiln control arrangement has been shown and described. The kiln control arrangement of the present invention allows a more simplified operation of a drying kiln, yet retains the desirable characteristic of close operator supervision and control. Because individual loads 13 may vary in moisture content, and kiln external conditions such as ambient air humidity and temperature, can greatly effect the drying time for a load 13, it is necessary that the drying operation be closely supervised by an operator. Under the present invention, a digital scale allows the operator to simply retrieve the sample boards from the kiln and sequentially place these boards on a scale coupled to the computer control system. The computer then calculates the average loss of moisture based on the most recent samples obtained and, further, can calculate a next anticipated time when an appropriate advance in the drying schedule is required. Without such assistance by the method of the present invention, the operator would be required to predict and make all scheduled changes, and perform all the steps necessary to derive actual moisture content values to be input manually into a computer system. This complex operation slows drying time due to the fact that some of these changes can occur at nights or on weekends and, therefore, appropriate advances in the drying schedule are delayed with corresponding greater overall drying times, and therefore, greater waste of energy resources associated with the operation of the kiln.

Under the present invention, such close supervision and control requires little expertise or time on the part of the operator. All the operator need do to update computer 16 as to the current moisture content of load 13 is to enter the kiln 10, collect the sample boards 20, and sequentially place each sample board 20 on scale 22 in association with its corresponding identification. The computer 16, as appropriately programmed under the method of the present invention, then determines the moisture content of load 13 and, based on this calculated moisture content, references the drying schedule 50 to suitably operate the kiln 10 under setpoints required for the current moisture content of the load 13.

The control arrangement of the present invention further provides limited automatic advance in the drying schedule 50 based on a calculated drying rate for the load 13. Under this automatic advance feature of the present invention, an operator may allow computer 16 to independently move the drying operation to a next stage in the drying schedule 50 when appropriate. Computer 16 can constantly calculate a drying rate as well as predict and display a likely time for the next advance in the drying schedule 50. An operator will come to appreciate the level of accuracy provided by the predicted advance in the drying schedule, and may find that the anticipated advances in the drying schedule are reasonably accurate, or at least useful in determining when to execute the check load procedure 100. For example, when kiln external conditions are fairly constant and the moisture content of incoming loads 13 is fairly constant, it is likely that computer 16 will accurately predict a next required advance in the drying schedule 50. In such case, the operator may enable the automatic advance feature and allow computer 16 to independently move the drying schedule 50 to its next stage based on the calculated drying rate for load 13 It is suggested, however, that the computer 16 not be given complete authority in indefinitely advancing the drying schedule 50. Because of the great variability in actual drying rates, it is unlikely that the computer 16 would maintain proper timing for the schedule 50 over an extended drying operation.

Thus the drying process for a kiln can be accelerated under the present invention by providing a minimal amount of information operator action, i.e., provide sample board weights and time of weighing by use of a scale coupled to the control system, and allowing the control system to make all necessary calculations. Thus, the operator need only collect sample boards from a kiln and sequentially deposit these sample boards on the scale 22 in order to drive the kiln from step-to-step in the drying schedule. As a result, a more efficient drying process is achieved and less energy resources are required to bring the kiln load to its desired moisture content.

It will be appreciated that the present invention is not restricted to the particular embodiment that has been described and illustrated, and that variations may be made therein without departing from the scope of the invention as found in the appended claims and equivalents thereof. For example, while the present invention has been illustrated in the context of hardwood drying procedures, it will be appreciated that the present invention may be employed in the kiln drying of a wide variety of board products and wood species. Also, while the present invention has been shown with a single scale device maintained external of the kiln and requiring that the operator bring sample boards to the scale and sequentially place each sample board on the scale, it should be appreciated that the scope of the invention would encompass more complicated and sophisticated systems wherein individual sample boards could be maintained on separate weighing devices within the kiln in such manner that the sample boards could remain within the kiln and the control system could monitor the variation in weight of the sample boards as the drying process continues.

What is claimed is:

1. In a kiln having a programmable control for implementing a drying schedule of a load within the kiln, an improvement comprising:

a scale providing weight values readable by said control;

a plurality of sample boards as a portion of said load, each sample board associated with a corresponding sample board identification readable by said control for identifying each of said plurality of sample boards; and a control program of said control reading each sample board identification in conjunction with a weight value from said scale and calculating moisture content characteristics of the load based on weight values of said plurality of sample boards as maintained as a portion of the load in the kiln whereby the control program may drive the load through a drying schedule by intermittently reading such weight values and sample board identifications.

2. An improvement according to claim 1 wherein improvement includes an operator interacting with said scale and said control and said scale is a single scale apparatus and said weight values are obtained by said operator sequentially placing ones of said sample boards thereon in conjunction with providing to said control program as readable input data the corresponding sample board identifications.

3. An improvement according to claim 1 wherein said control program calculates at least two average moisture content values based on corresponding at least two readings of weight values from said scale, maintains a representation of a separation in time between reading of said at least two weight values, and calculates a drying rate based on said average moisture content values for use in anticipating a time for a next required advance in the drying schedule.

4. An improvement according to claim 3 wherein said control program automatically advances the drying schedule based on said calculated drying rate.

5. An improvement according to claim 4 wherein said control program is limited with respect to the number of times the control mechanism can automatically advance the drying schedule.

6. An improvement according to claim 4 wherein said control program activates an alarm at a time corresponding to a next anticipated advance in the drying schedule based on said calculated drying rate.

7. An improvement according to claim 4 wherein said control program reports to an operator the time of a next anticipated advance in the drying schedule based on said calculated drying rate.

8. An improvement according to claim 1 wherein said improvement includes an operator and said control program initiates a load drying cycle by interaction with said operator whereby said operator places sample boards on said scale in association with corresponding sample board identifications and records the initial weight of each sample board in association with the corresponding sample board identification.

9. An improvement according to claim 1 wherein said improvement includes an operator and said control checks moisture content of said load by interacting with said operator collecting said sample boards from said kiln and placing said sample boards on said scale for reading by said control program in association with input to said control program of said corresponding sample board identifications whereby said control program reads said identifications and said weight values.

10. A method of drying kiln control operation, said kiln having a kiln control the method comprising:

loading a kiln with a load of articles to be dried;

selecting sample articles from said load;

associating each sample article with a sample article identification;

selecting a drying schedule for said load, said drying schedule providing kiln condition setpoints as a function of load moisture content and including a desired moisture content for said load;

collecting initial sample article data corresponding to moisture content by presentation of each of said sample articles to a scale of said kiln control conjunction with the associated identification;

calculating within said kiln control a moisture content value for said load based on the most recently collected sample article data collected;

establishing kiln condition setpoints from said selected drying schedule as a function of the most recently calculated moisture content for said load;

operating said kiln by said control to maintain the most recently established kiln condition setpoints; and provoking by said kiln control of intermittent interaction between said kiln control and an operator collecting said sample article from said kiln and presenting said sample articles to said kiln control in association with the corresponding sample article identification whereby said kiln control collects sample article data corresponding to moisture content in association with the corresponding sample article identification, repeats the steps of calculating a moisture content and establishing kiln condition setpoints, and continues the step of operating said kiln.

11. A method according to claim 10 wherein said kiln control terminates operation of said kiln when said calculated moisture content of said load is less than or equal to a desired moisture content for said load.

12. A method according to claim 10 wherein said condition setpoints include dry-bulb and wet-bulb conditions of said kiln.

13. A method according to claim 10 wherein said sample article data collected is sample article weight provided by operation presentation of said sample articles on a scale providing weight values to said kiln control in association with corresponding sample article identifications.

14. A method of drying kiln control operation said kiln having a kiln control, the method comprising:

loading a kiln with a load of articles to dried;

selecting sample articles from said load;

associating each sample article with a sample article identification;

selecting a drying schedule for said load, said drying schedule providing kiln condition setpoints as a function of load moisture content and including a desired moisture content for said load;

collecting initial sample article data corresponding to moisture content;

calculating a moisture content value for said load based on the most recently collected sample article data collected;

establishing kiln condition setpoints from said selected drying schedule as a function of the most recently calculated moisture content for said;

operating said kiln in such manner to maintain the most recently established kiln condition setpoints; and provoking intermittent interaction between said kiln control and an operator collecting said sample articles from said kiln and presenting said sample articles to said kiln control in association with the corresponding sample article identification whereby said kiln control collects sample article data corresponding to moisture content in association with the corresponding sample article identification, repeats the steps of calculating a moisture content and establishing kiln condition setpoints, and continues the step of operating said kiln, said control calculating a drying rate based upon at least two steps of calculating a moisture content for said load and anticipating by use of said drying rate and reference to said drying schedule a time for next advancing said drying schedule.

15. A method according to claim 14 wherein said kiln control automatically advances the drying schedule based on said calculated drying rate.

16. A method according to claim 15 wherein said kiln control is limited with respect to the number of times the control mechanism can automatically advance the drying schedule.

17. A method according to claim 15 wherein said kiln control activates an alarm at a time corresponding to a next anticipated advance in the drying schedule based on said calculated drying rate to inform the operator that interaction with the kiln control is required.

18. A method according to claim 15 wherein said kiln control reports to said operator the time of a next anticipated advance in the drying schedule based on said calculated drying rate whereby said operator may at that time interact with the kiln control to present said sample articles in association with the corresponding sample article identifications whereby said kiln control may collect said sample article data.

* * * * *